United States Patent [19]

Hoffman

[11] Patent Number: 4,556,075

[45] Date of Patent: Dec. 3, 1985

[54] TWO-IN-ONE QUICK RELEASE CANE

[76] Inventor: William P. Hoffman, 12550 Biscayne Blvd., North Miami, Fla. 33181

[21] Appl. No.: 604,172

[22] Filed: Apr. 26, 1984

[51] Int. Cl.[4] ..... A45B 3/00
[52] U.S. Cl. ..... 135/65
[58] Field of Search ..... 135/65, 66

[56] References Cited

U.S. PATENT DOCUMENTS 1,375,912 4/1921 Huddle ..... 135/65
2,932,526 4/1960 Campbell ..... 135/66 X

FOREIGN PATENT DOCUMENTS 175482 10/1906 Fed. Rep. of Germany ..... 135/66
341496 10/1921 Fed. Rep. of Germany ..... 135/65
2360067 6/1975 Fed. Rep. of Germany ..... 135/65

*Primary Examiner*—Robert A. Hafer
*Assistant Examiner*—Arnold W. Kramer
*Attorney, Agent, or Firm*—Harry W. Barron

[57] ABSTRACT

There is disclosed a two-in-one quick release cane in which an inner cane fits in the support member of an outer cane. The outer cane is longitudinally hinged to allow the two canes to be easily separated so that the user can quickly switch from using a single cane to a pair of canes to assist his mobility.

1 Claim, 9 Drawing Figures

TWO-IN-ONE QUICK RELEASE CANE

This invention relates to canes and more particularly to a cane which can be separated into two canes.

Many people because of injury or paralysis require the aid of a cane to walk. Typically the cane functions to replace an injured leg. The person using the cane holds onto the cane handle with an arm and instead of placing pressure on the injured or immobile leg, leans on the cane. This transfers the hindered normal lower body mobility to the more mobile upper body.

Some people however have immobility in both legs. For these people, using a single cane to assist walking is useful, however where such a person desires to walk at a more brisk pace, it is preferable to use two canes, one for each hand. In this manner the person can lean from side to side placing weight on the canes as he walks. Using two canes has the disadvantage that both hands are then engaged with the canes, and this prevents the person from, for instance, carrying a package or otherwise using one of the two arms. It would be better to have a cane designed which can be separated and used as two canes and be enclosed in a single package and used as a single cane, as the user's desires dictate. Such a separable, or two in one cane, should be easily separated and reconnected.

Typically the user will only require a single cane. However, where such a person is going up or down a stadium ramp, through a dark movie aisle, or crossing rough ground, the second cane becomes very useful. The user should be able to quickly separate the canes, use the two where needed, and then reconnect them when the needed use is over.

The prior art includes U.S. Pat. No. 768,452 to G. J. Hennessy which shows a combination cane/crutch which can be expanded from a cane to a longer crutch. However, this device is not totally separatable so that the two parts thereof can function as two canes.

In accordance with one aspect of this invention there is provided a two-in-one cane used to assist a person's mobility comprising outer cane means and inner cane means, each of said cane means having a handle and a support member intergal to one another. The support members are substantially the same length and size so that the inner support member is encased by the outer support member. The handles of both canes are shaped to form a common handle when the inner support member is encased. Additionally the cane comprises means included as a part of the outer cane to permit the inner cane to be removed from the outer cane whereby two separate and independent canes are selectively useable to assist a person's mobility.

One preferred embodiment of the subject invention is hereafter described with specific reference being made to the following figures in which.

Figure 1:
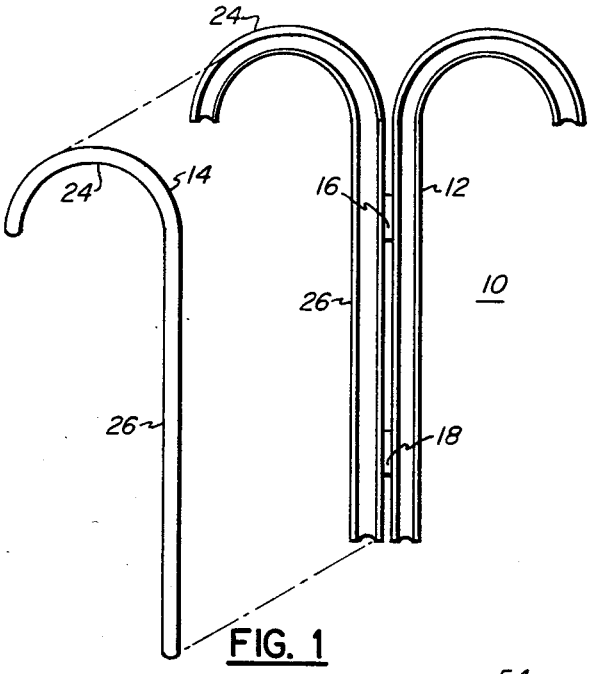
FIG. 1 shows one embodiment of the two-in-one cane of the subject invention when the canes are being separated.
Figure 2:
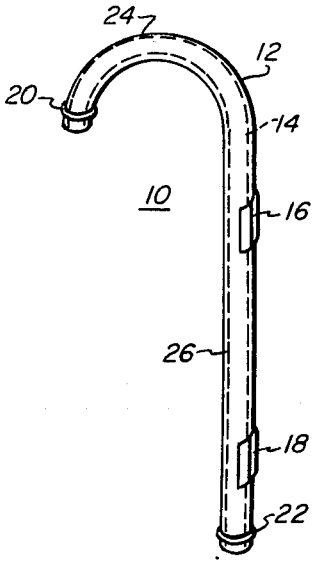
FIG. 2 shows the canes of FIG. 1 when in a combined configuration.

Referring now to FIGS. 1 and 2, one preferred embodiment of the two-in-one quick release cane 10 is shown. Cane 10 includes an outer cane 12 and an inner cane 14 which is sized to fit within the hollow inside of outer cane 12. In the embodiment shown in FIGS. 1 and 2, outer cane 12 is two semicylindrical elements hinged together by hinges 16 and 18. As outer cane 12 is opened, inner cane 14 fits within the hollow portion thereof. When inner cane 14 is within outer cane 12, as shown in FIG. 2, outer cane 12 may be held together by a pair of bands 20 and 22, such as heavy rubber bands or the like, positioned at both ends of the cane. As with any cane, cane 10 includes a handle 24 and a vertical support 26. Handle 24 may be generally semi-circular in shape and provide a place for the patient to hold onto the cane. Vertical support 26 should be of sufficient length so that handle 24 is an appropriate distance off the ground to make it comfortable for the patient to use the cane. It is important that vertical support 26 in inner cane 14 be substantially the same length as vertical support 26 in outer cane 12 so that the person utilizing both canes will feel balanced. Appropriate rubber bottoms may extend from inside inner cane 14 and from around the outside of outer cane 12.

Figure 3:
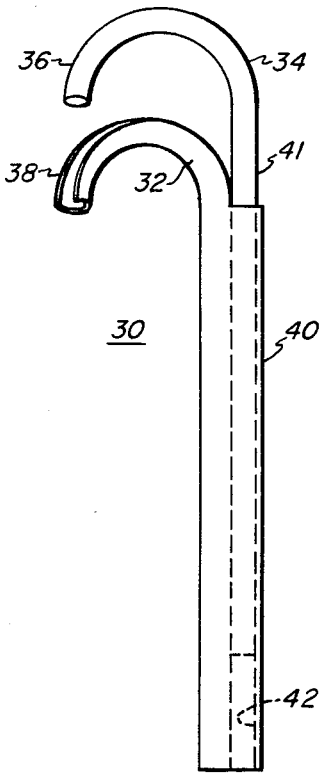
FIGS. 3 and 3A show a second embodiment of the cane of the subject invention.
Figure 3A:
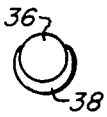

Referring now to FIG. 3, the second preferred embodiment of the present invention is shown. In FIG. 3 cane assembly 30 consists of an outer cane 32 and an inner cane 34. The handle 36 of inner cane 34 is generally circular in shape and the handle 38 of outer cane 32 is designed so that the handle 36 of inner cane 34 snap fits therein. Specifically, as shown in FIG. 3A, handle 38 is a crescent shape in which the two ends of the crescent are displaced over the handle material by more than 180°. In this manner handle 36 can be snapped into the crescent portion of handle 38 and held in place thereby replacing, for instance, the necessity of the bands 20 and 22 shown in FIG. 2.

The support 40 of outer cane 32 is approximately twice the width or diameter of the handles 36 and 38 with the additional space being on the side away from handle 38. An opening 42 in the extended part of support 40 allows the support 41 of inner cane 34 to be inserted into support 40. To convert cane assembly 30 into two canes, one merely pulls inner cane 34 upward and removes it from opening 42 utilizing the handle 36 of inner cane 34 as one cane and the handle 38 of outer cane 32 as the second cane. The support portions 41 and 40 of inner cane 34 and outer cane 32 are made approximately the same length so that the person using both canes will feel balanced.

Figure 4:
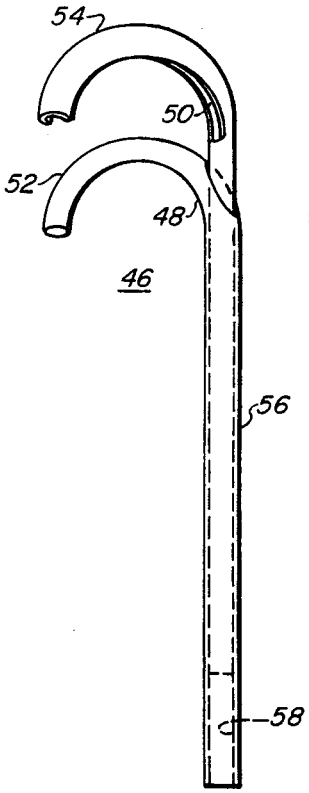
FIGS. 4 and 4A shows a third embodiment of the cane of the subject invention.
Figure 4A:
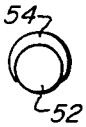

Referring now to FIGS. 4 and 4A a third preferred embodiment of the subject invention is shown. In FIG. 4, cane assembly 46 is similar to cane assembly 30 shown in FIG. 3, except that the handle 54 of inner cane 50 is crescent shaped and the handle 52 of outer cane 48 is circular shaped. Handle 54 snap fits over handle 52 as shown in FIG. 4A. The opening 58 for cane assembly 46 is within the hollow support 56 of outer cane 48. The opening extends up through handle 52. Again the two support members of canes 48 and 50 are approximately the same length.

Figure 5:
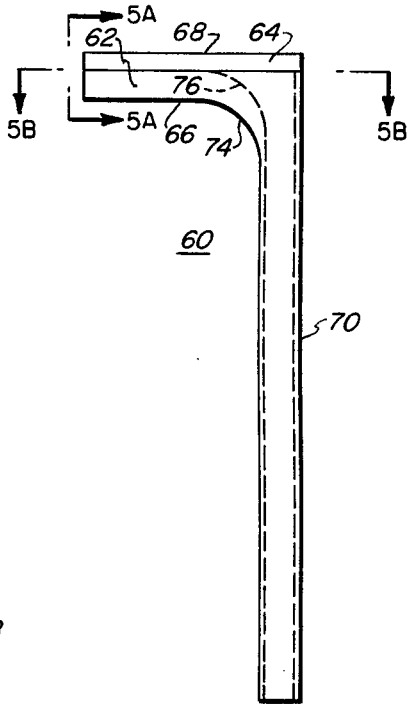
FIGS. 5, 5A and 5B show a fourth embodiment of the cane of the subject invention.
Figure 5A:
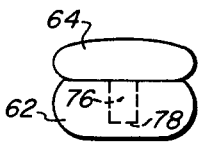
Figure 5B:
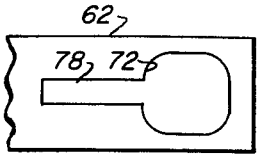

Referring now to FIGS. 5, 5A and 5B, a fourth preferred embodiment of the subject invention is shown. Again the outer cane 60 includes a hollow support member 70 into which inner cane 64 is positioned through an opening 72. Handle 66 of outer cane 62 and handle 68 of inner cane 64 are generally straight members positioned perpendicular to the support 70. They are held by braces 74 and 76 which may be angular or semicircular members between support 70 and handle 66 or 68. An opening 78 in handle 66 is sized and positioned to allow the brace 76 of inner cane to fit therein. This provides support to prevent the two handles from rotating with respect to one another. FIG. 5B shows a view looking down on handle 66 of outer cane 62 showing the brace opening 78 and the support opening 72 for the support 70 of inner cane 64 to be positioned into.

What I claim is:

1. A two-in-one cane used to assist a person's mobility comprising:

outer cane means and inner cane means, each of said cane means having a handle and a support member integrally to one another, said support members being substantially the same length and sized so that said inner support member is encased by said outer support member, said handles of both canes being shaped to integrally form a common handle when said inner support member is encased, and means included as a part of said outer cane to permit said inner cane to be removed from said outer cane, whereby two separate and independent canes are selectively useable to assist said person's mobility;

wherein said outer cane includes two halves hingedly connected.

* * * * *